United States Patent [19]

Gordon et al.

[11] 3,977,526

[45] Aug. 31, 1976

[54] TRACKING SYSTEMS FOR SORTING APPARATUS

[75] Inventors: Roderick J. Gordon, Peterborough, Canada; Hilton P. Gordon, Johannesburg, South Africa

[73] Assignee: Sphere Investments Limited, Nassau, Bahamas

[22] Filed: June 27, 1975

[21] Appl. No.: 591,230

[52] U.S. Cl. ..... 209/111.7 R; 209/74 M

[51] Int. Cl.[2] ..... B07C 5/10

[58] Field of Search ..... 209/73, 74 R, 74 M, 209/111.5, 111.6, 111.7 R, 111.7 T; 250/563

[56] References Cited

UNITED STATES PATENTS 3,581,888 6/1971 Kelly et al. ..... 209/74 R

*Primary Examiner*—Robert B. Reeves
*Assistant Examiner*—Joseph J. Rolla

[57] ABSTRACT

A tracking system for a sorting apparatus for sorting pieces of material moving through a sorting zone in a wide path random stream has a light scanning device which makes repeated scans across the sorting zone to detect light reflected from the pieces of material, and downstream of the scanning device a plurality of deflection devices extending across the sorting zone. An electronic control generates timing signals which, in effect, represent a plurality of overlapping analyzing channels extending in the direction of movement of the pieces of material and overlapping one another across the sorting zone. An electrical circuit arrangement for each analyzing channel receives signals from the scanning device and accumulates information relating to pieces of material in that channel and provides a decision signal based on the accumulated information. A control for each analyzing channel is responsive to the decision signal for that channel to actuate a number of deflection devices which extend at least the width of the channel. Because the analyzing channels overlap it is more probable that a piece of material will be within or substantially within one channel for analysis.

19 Claims, 13 Drawing Figures

TRACKING SYSTEMS FOR SORTING APPARATUS

This invention relates to a tracking system for sorting apparatus, and in particular it relates to a tracking system for a sorting apparatus which sorts pieces of material moving through the apparatus in a randon stream.

In the sorting of pieces of material, such as pieces or particles of ore, it is advantageous to be able to analyse and evaluate each piece of material as it moves through the sorting zone and to reject or accept individual pieces of the material on the basis of the evaluation. This provides very efficient sorting. It has been found to be difficult to separate the pieces so that they are suitably spaced with a desired accuracy of spacing, such as in columns of spaced pieces, and it may result in a lower throughput than if the pieces of material are moving in a random stream. However, when pieces of material move through a sorting zone in a random stream it is necessary to evaluate or analyse each piece of material with reference to the position of that piece of material in the stream so that an individual piece may be accepted or rejected when it passes the rejection means. While sorting of a random stream normally results in a greater throughput and greater efficiency, a more complex system is usually required.

In a photometric type of sorting apparatus, for example, pieces of material move through a sorting zone in a random stream and a scanning device makes repeated scans across the stream to provide a signal in accordance with certain characteristics of the scanned pieces of material. The signal is accumulated for each scan to provide data representing the characteristics of the pieces of material. This data must be related to each piece of material and to the position of each piece of material so that the individual piece of material can be accepted or rejected according to the analysis of the data. This obtaining of data and relating it to a particular piece of material and to the position of the piece of material has been termed "tracking" in the sorting art.

Various types of tracking systems are known in the prior art. For example, one type of prior art apparatus has a sorting zone with a plurality of imaginary channels extending longitudinally through the sorting zone. The channels are defined by a rejection means which extends across the sorting zone near the end of the sorting zone. The rejection means comprises a plurality of rejection devices positioned side by side, and these rejection devices are commonly air blast nozzles for directing a blast of air the width of an "imaginary" channel into the random stream to deflect pieces of material moving along that particular channel. The rejection device can deflect a piece of material which lies wholly within its channel but it may or may not deflect a piece of material which lies partly in its channel and partly in one or more adjacent channels. In this type of apparatus, each channel is treated as a unit. This is, the sorting zone is scanned and the scanning information on the characteristics of the scanned material is allocated to a unit of circuitry for each respective channel. A unit may comprise a memory to store data on the characteristics, an analysing device to analyse the data, a decision device to provide an accept or reject signal on the basis of the analysed data, and control circuitry to actuate the respective rejection device according to the decision signal. It will be seen that a piece of material lying partly in one channel and partly in the adjacent channel will be treated as two separate units, and the circuitry for each channel will process the data for that channel to give a decision based on the data for that channel. If the piece of material should extend into a third channel, then the third channel would treat that portion as a unit. As the valuable portion and waste portion might lie in different channels a piece of material in more than one channel may not be correctly sorted.

Another type of prior art apparatus attempted to analyse each piece of material separately without regard to the position or number of channels occupied by the piece of material. In this type of apparatus there were a number of modules (less than the number of channels) and each module would "lock on" a piece of material. That is, when the scan encountered a new piece of material the first available module would lock onto that piece and accumulate data on that piece only for all the scans which traversed it. It would then analyse the data and provide a decision signal. The decision signal would then have to be related to the particular channels (i.e. rejection devices) concerned, and the longitudinal extent or size would also be provided to the rejection devices for timing the rejection blast. While this normally reduced the number of analysing and decision circuits, it required quite a considerable amount of complex circuitry to relate a module to the appropriate channel or channels.

The present invention requires relatively simple circuitry yet provides good sorting of pieces of material which in prior art apparatus would be considered as being in two or more channels.

It is therefore an object of the invention to provide an improved tracking system which requires relatively uncomplicated circuitry.

It is another object of the invention to provide a tracking system for a sorting apparatus which provides for a plurality of overlapping analysing channels whereby a piece of material which extends outside one particular analysing channel would in most instances lie substantially within another analysing channel which overlaps the particular analysing channel.

According to one aspect of the invention there is provided a tracking system for a sorting apparatus for sorting pieces of material moving through a sorting zone in a wide path random stream, comprising scanning means to make repeated scans across the sorting zone to detect light reflected from discrete areas of each piece of material as the scan traverses the piece of material and to provide a scan signal representative of the reflected light, deflection means downstream of said scanning means and comprising a plurality of deflection devices extending across said sorting zone, each device having a first condition which permits pieces of material passing it to follow a predetermined undeflected path and a second condition which deflects passing pieces of material from said predetermined path, electronic means generating timing signals related to the rate at which the scan traverses the sorting zone, said timing signals representing a plurality of overlapping analysing channels each extending parallel to the direction of movement of the pieces of material through the sorting zone, circuit means for each analysing channel each receiving said scan signal and a respective timing signal for accumulating information from said scan signal relating to pieces of material in the respective analysing channel and providing a decision signal based on the accumulated information on a piece of material, and control means for each analysing channel respective to said decision signal to actuate a number of deflection devices extending at least the width of the analysing channel.

The invention will be described with reference to the accompanying drawings in which:

FIG. 1 is a schematic side view of a sorting apparatus incorporating a tracking system according to this invention.

FIGS. 2(A), (B), (C) and (D) are partial schematic views of the rejection means of some different embodiments of the sorting apparatus indicating the various channels.

FIGS. 5(A) and (B) are schematic drawings showing typical pieces of material in a sorting zone, useful in describing the operation of the apparatus.

FIGS. 6(A) and (B) are schematic drawings of pieces of material which are touching.

Figure 8:
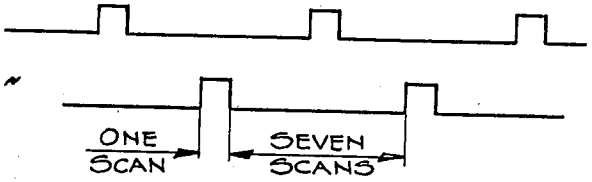
Figure 7:
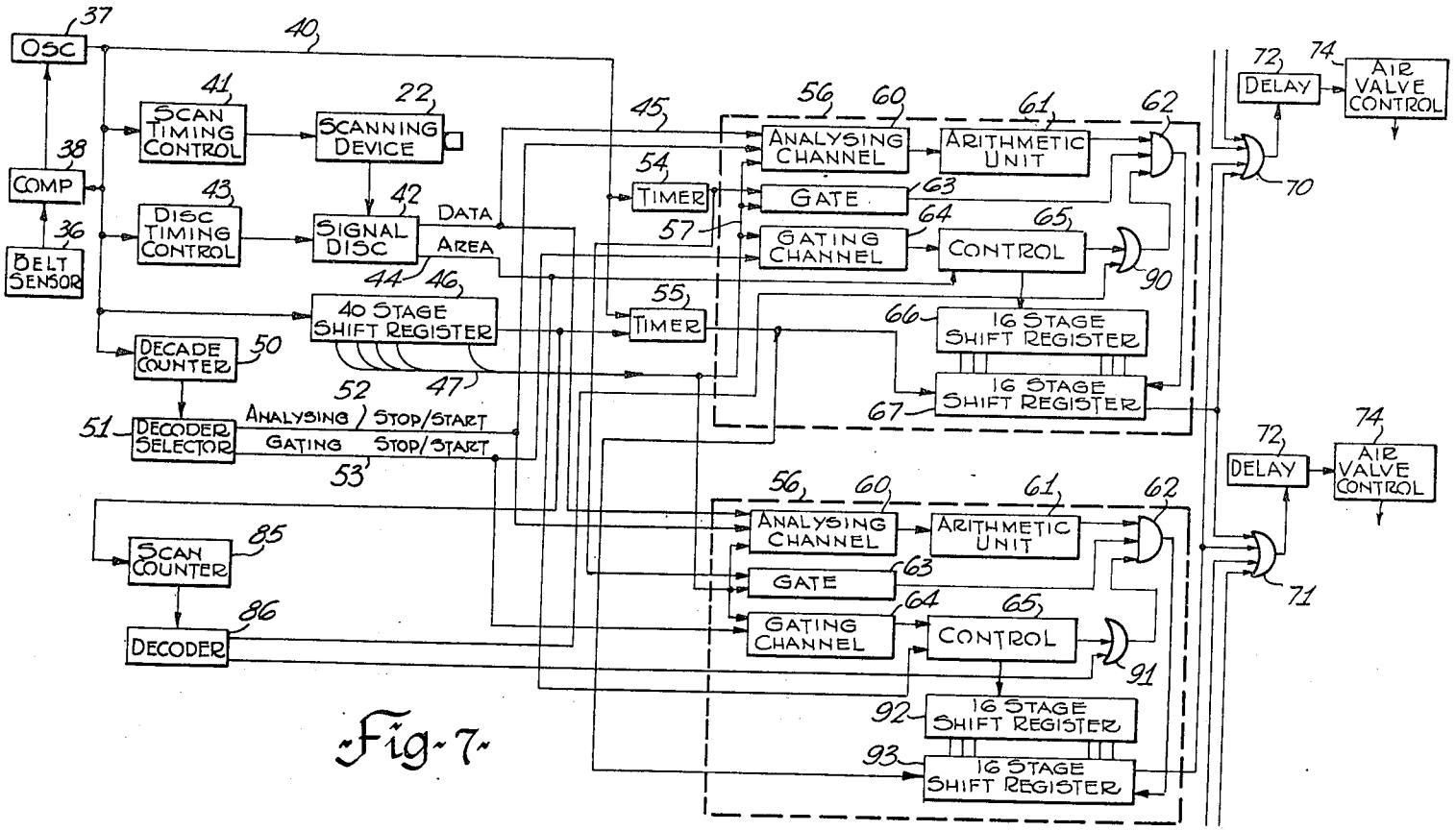

FIG. 7 is a schematic block diagram showing another embodiment of the invention, and FIG. 8 (on the same sheet of drawings as FIG. 1) is a waveform diagram useful in describing the operation of FIG. 7.

The invention will be described as it relates to the sorting of ore, but it will be apparent that the invention may be used for tracking in the inspection of or sorting of other pieces of material.

In the sorting of ore the sizes or size ranges of the pieces or particles are of some significance. Particle sizes are usually stated in terms of dimensions of square mesh screens through which particles will or will not pass. For example, a group of particles designated as −25 mm to +10 mm (or simply −25 mm +10 mm) will consist of particles which will pass through a 25 mm square mesh screen but will not pass through a 10 mm square mesh screen. The size range of pieces of rock or particles which it is generally considered feasible to sort by automatic machinery is very roughly −150 mm +10 mm, but it is not possible to sort the entire range on a single random stream machine. This is because the larger particles tend to obscure the smaller ones. Some of the size ranges which are typical for feeds to a single sorting machine might be any one of the following size ranges:

−150 mm +75 mm
−125 mm +50 mm
−100 mm +50 mm
−75 mm +35 mm
−60 mm +30 mm
−40 mm +15 mm
−25 mm +10 mm

It will be observed that, very approximately, the coarser screen has a pitch of two to two and a half times the finer screen. It has been found in practice that this order of ratios permits effective sorting without undue obscuring of smaller particles while maintaining a good sorting rate.

The tracking system as described herein can be adapted to any of the size ranges indicated above. For any size range certain parameters should be chosen in the design of the system. For example, the number of rejection devices (which are normally air blast nozzles) must be chosen and the width or lateral extent of each device will then be fixed. If a feed range to a sorting apparatus is −40 mm +15 mm, and the sorting zone is 800 mm wide, then, for example, a suitable arrangement might be 40 air blast nozzles each of 20 mm in width. A smaller particle in this size range with this nozzle configuration might result in a deflecting air blast from one nozzle or from two nozzles depending on the position and configuration of the particle, whereas a larger particle might require a blast from two or perhaps three nozzles. It will be seen that the selection of a particular size of air blast nozzle will be associated with a particular range of sizes or perhaps with two or three ranges of sizes, and a different selection would be made for other ranges of sizes.

Figure 1:
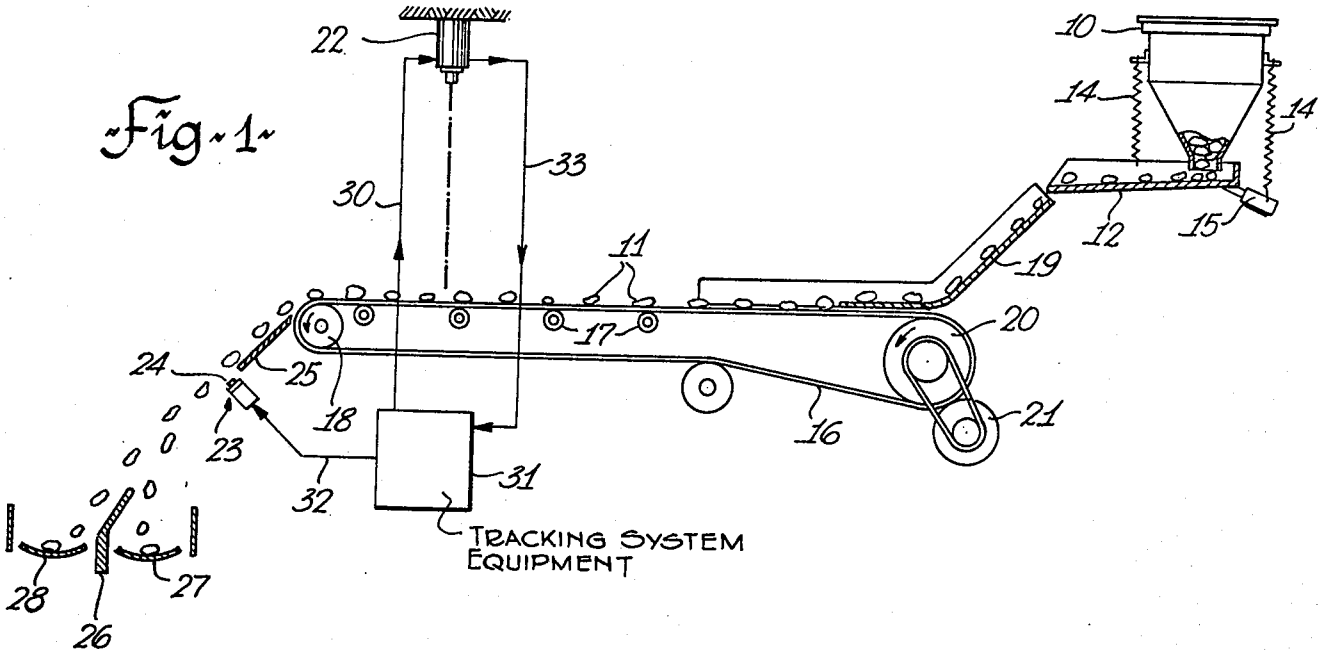

Referring now to FIG. 1 there is shown a sorting apparatus which sorts pieces of material, which will for convenience of description be referred to as, for example, moving through it in a wide path random stream. The expression wide path random stream is intended to mean a stream of particles moving in a given direction and having haphazard alignment and spacing with a sufficient width to permit a plurality of particles to move along in side by side relationship. A hopper 10 is shown holding a quantity of pieces or particles of rock 11 so that the particles are discharged onto a vibrating table 12 which is suspended by springs 14. A vibrating motor 15 drives the table 12 in a manner well known in the art. The table 12 discharges particles 11 onto a slide plate 19 which accelerates them and distributes the particles 11 over the surface of a belt 16 in a wide path random stream. The endless belt 16 is supported by idlers 17 between a head roller 18 and a drive roller 20. The drive roller 20 is driven by a motor 21.

The particles of rock 11 move along on belt 16 past a scanning device 22 and are discharged in a free fall trajectory at head roller 18. The particles pass a rejection means 23 which may comprise a number of adjacent rejection devices such as air blast nozzles 24. A guard plate 25 immediately above nozzles 24 is provided to protect the nozzles from accidental damage which conceivably might be caused by abnormal rock position. The guard plate 25 is normally not touched by passing particles. A splitter plate 26 is provided beneath the air blast nozzles 24 and positioned so that undeflected particles fall on one side onto a belt 27 and deflected particles pass on the other side and fall on belt 28.

Timing and control signals are exchanged over conductor 30 between scanning device 22 and tracking system equipment 31, and rejection means 23 receives control signals over conductor 32 from equipment 31. The scanning device 22 provides information on the scanned area over conductor 33 to the tracking system equipment 31.

Figure 2:
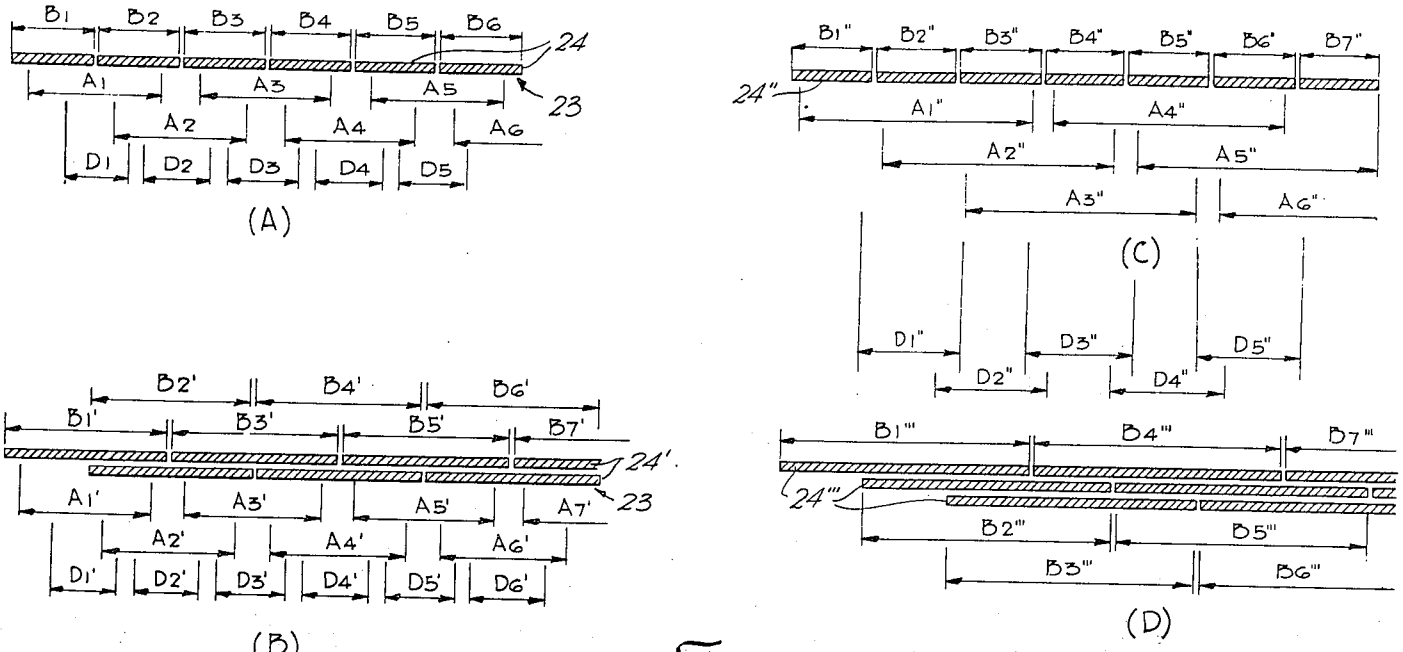

The tracking system makes use of various analysing and gating channels as can be described generally with reference to FIG. 2. Referring first to FIG. 2(A), a portion of rejection means 23 is shown with air blast nozzles 24. The air blast nozzles 24 each define an imaginary channel of which several are indicated and designated B1, B2, B3, B4, etc. These are "blast channels". A first analysing channel is shown as A1 and is centered on the dividing line between blast channels B1 and B2. A second analysing channel is shown as A3 and is centered on the dividing line between blast channels B3 and B4. These analysing channels have an adjustable width which is greater than the width of one blast channel and less than the width of two blast channels and is preferably selected to be just less than the width of two blast channels. There is another series of overlapping analysing channels and one of these is indicated at A2 and is shown centered on the dividing line between blast channels B2 and B3. The analysing channels A1, A3, A5, etc. and A2, A4, A6, etc. continue overlapping in the same manner right across the width of the rejection means. A plurality of gating channels are indicated as D1, D2, D3, etc. and these also extend across the width of the rejection means. Each gating channel is normally slightly smaller in width than the width of a blast channel and is centered on the dividing line between each blast channel as shown. The width of the gating channels is also adjustable to make it adaptable to different sorting situations.

It will be seen that at either end of the rejection means there will be a portion of an analysing channel and a portion of a gating channel that is, in effect, inactive because no particles will appear outside the limits of the stream of particles which extends only the width of the rejection means.

It should be kept in mind that the channels are imaginary. That is, there is no physical wall defining any of the channels. The channels may be said to be defined in the electronics of the tracking system as will be described hereinafter.

Very briefly, the gating channels D1, D2, etc. define the width within which a particle must be detected in order that a respective analysing channel A1, A2, etc. may be enabled. The analysing channels do not accumulate data until they are enabled by the gating channel. By making the gating channel narrower than the analysing channel, there is a tendency to avoid analysis of particles which just extend into an analysing channel. If an analysing channel receives data which result in a decision to deflect a particle, then two air blast devices 24 are actuated. The two devices actuated are for the blast channels which are adjacent and the line separating them is the centre line of the analysing channel which provided the signal to deflect.

It will be seen that if the width of a gating channel were made equal to the width of an analysing channel, then the purpose of the gating channel becomes redundant. Thus, if the particular apparatus for sorting a particular ore would not use to advantage a gating channel, the apparatus would function without one as is apparent from the description.

Referring now to FIG. 2(B) there is shown an embodiment which has two adjacent rows, of nozzles 24'. These nozzles 24' are arranged in an overlapping arrangement in the same manner as the analysing channels A1', A2', A3', etc. Thus there are blast channels B1', B2', B3', etc., corresponding each to a respective analysing channel. The blast channel as shown is slightly greater in width than an analysing channel, however, the blast channel could be as little as one half the width of an analysing channel or perhaps as large as one and one half the width of an analysing channel. As in the embodiment of FIG. 2(A), the gating channels D1', D2', etc. are centered with respect to the respective analysing channels A1', A2', etc.

As can be seen, the embodiment of FIG. 2(B) is quite similar to that of FIG. 2(A) in operation. A particle which was wholly within, for example, analysing channel A2' and which was such that a deflection signal resulted, would cause an air blast from the nozzle corresponding to blast channel B2'. Whereas two nozzles were actuated in the FIG. 2(A) embodiment, only one nozzle is actuated in the FIG. 2(B) embodiment, but the width of the deflecting air blast could be substantially the same because the individual nozzles could be twice as big.

Referring now to FIG. 2(C) and 2(D) there are shown embodiments where the analysing channels overlap in threes. FIG. 2(C) shows nozzles 24 defining blast channels B1'', B2'', etc. which are actuated in threes. That is, the analysing channel A2'', for example, would actuate nozzles corresponding to blast channels B2'', B3'' and B4''. In FIG. 2(D) the analysing channel A2'' would actuate the nozzle corresponding to blast channel B2''' (which is substantially the same width as B2'', B3'' and B4'' together). It will be seen that the overlapping analysing channels consist of a first, second and third set. The first set comprise analysing channels A1'', A4'', etc.; the second set comprise analysing channels A2'', A5'', etc.; and the third set comprise analysing channels A3'', A6'', etc. Each channel in the second set A2'', A5'', etc. overlaps adjacent channels in the first set. That is channel A2'' overlaps channel A1'' by an amount preferably no greater than two thirds the width of an analysing channel and A2'' overlaps channel A4'' by an amount preferably no greater than one third of the width of an analysing channel. Similarly an analysing channel in the third set (e.g. A3'') overlaps a pair of adjacent channels (e.g. A1'' and A4'') in the first set, one by an amount preferably no greater than one third the width of the channel and the other by an amount preferably no greater than two thirds.

It will be apparent that arrangements for overlapping in other multiples or in other degrees could be used depending on the design requirements.

The circuitry will be described briefly with reference to FIGS. 3 and 4 which particularly relates to the channel arrangement of FIG. 2(A). A belt sensor 36 provides a signal to comparator 38 related to the speed of belt 16 (FIG. 1). An oscillator 37 provides on conductor 40 a basic timing control signal, which may be as indicated in FIG. 4(*a*), for the apparatus and this is also applied to comparator 38. Comparator 38 provides a control signal to oscillator 37 to control the output of the oscillator 37 so that it is always related to the speed of the belt. Such controls are well known in the art. It will be apparent that such a control arrangement is not essential to the invention.

A scanning device 22, which may conveniently be of the type described in U.S. Pat. No. 3,901,388, is arranged to make repeated scans across the sorting zone to detect light reflected from discrete areas of each particle as the scan traverses it. Mechanical and electrical scanning devices are known in the art. The particles are carried through the scan on the belt as previously described. The scanning device 22 receives a timing and control signal from scan timing control 41, and scan timing control 41 is, in turn, timed by timing pulses on conductor 40.

Scanning device 22 provides an output signal to the signal discriminator 42 and this signal is representative of reflected light received by the scanning device 22. The signal discriminator 42 may include AGC circuitry and other stabilizing circuitry. The discriminator 42 also receives a timing and control signal from the discriminator timing control 43, which in turn receives timing pulses from conductor 40. The signal discriminator 42 provides two outputs. One output represents the extent or size, and the other represents the data on the characteristics of the reflected light. The data might include, for example, a representation of area, of a white value in excess of a predetermined level of reflected light, of a black value below a predetermined level, of a white signal squared, of a black signal squared, and of counts representing a swing from black to white or vice versa within a predetermined time, or other values. These signals are available on conductors 44 and 45 respectively.

A shift register 46 is stepped by the timing pulses on conductor 40 and it provides on cable 47 a series of gating control signals for the blast channels so that the blast channels may be enabled in sequence across the sorting zone and in synchronism with the scan. Three blast channel waveforms are shown in FIGS. 4(*b*), (*c*) and (*d*). The block 46 is labelled as a 40 stage shift register assuming there are 40 blast channels but, of course, shift registers would be selected according to whatever number of channels were called for by the design.

A decade counter 50 counts the pulses on conductor 40 in tens. In the embodiment being described each blast channel may therefore be considered as having ten parts. A decoder selector 51 is connected to the counter 50 and this provides two outputs on conductors 52 and 53. The output on conductor 52 is a series of start/stop pulses for the various analysing channels, and the output on conductor 53 is a series of start/stop pulses for the gating channels. The decoder selector 51 provides means for adjusting the width of the analysing channels and gating channels by tenths of a blast channel, and the two can be adjusted separately. For example, the waveform in FIG. 4(*e*) shows a typical series of analysing channel start pulses and the waveform in FIG. 4(*f*) shows a typical series of analysing channel stop pulses. Similar pulses (not shown) are provided, as described, on conductor 53 for the gating channels.

A timer 54 which normally includes a flip flop, provides a waveform such as is indicated in FIG. 4(*g*) which is used to call for a decision as will subsequently be described. A timer 55 receives a signal from conductor 40 and from shift register 46 to provide a signal for timing a deflecting blast as will subsequently be described and representing one pulse per scan.

The circuitry described so far is circuitry which is common. That is, there is one for the apparatus. The circuitry to be described hereinafter will relate in the main to one analysing channel. There will be similar circuitry for each channel. In FIG. 3 the broken line 56 indicates generally one analysing channel. The inputs to the circuit module designated by broken line 56 are all multiple inputs and would go to the other channels, except the input on conductor 57 (from cable 47) is the signal from shift register 46 for that particular channel.

The analysing channel circuitry 60 receives a data signal on conductor 45, an analysing channel start/stop signal on conductor 52 and a channel gate on conductor 57. The start/stop signal and the gate are used to provide an analysing channel signal such as is indicated in waveform *h* of FIG. 4. FIGS. 4(*h*) and 4(*i*) show two overlapping analysing channel waveforms as an example. The circuitry 60 thus analyses the data received on conductor 45 for the time period corresponding to, for example, waveform *h* in FIG. 4. It provides an output to arithmetic unit 61 which according to a predetermined program compares the accumulated data and provides an output according to the comparison representing a decision to deflect or not to deflect. The signal representing this is one input to AND gate 62. As one example only of suitable decision circuitry, reference is made to Canadian patent No. 923,601 issued Mar. 27, 1973.

A gate circuit 63 receives one input from timer 54 and one input from conductor 57 representing the particular channel and it provides a decision control signal (such as at waveform *g* in FIG. 4) but for that channel only. This signal is another input to AND gate 62.

Gating channel circuitry 64 receives a gating start/stop signal from conductor 53 and a particular channel signal from conductor 57. It provides as an output a signal such as waveform *j* in FIG. 4. This would be the gating waveform associated with analysing channel waveform *h*. Also shown in FIG. 4 at *k* is another gating channel waveform that would be associated with analysing channel waveform *i*. It will be noted the gating waveforms are centrally located within the respective analysing channel waveforms and are centrally located with regard to the boundary between blast channel waveforms.

The gating channel circuitry 64 provides one input signal to control 65, the other input to control 65 is the area signal on conductor 44. The control 65 provides an output whenever a particle is present during that gating channel waveform and the output is applied as a third input to AND gate 62. An output is also applied to a shift register 66.

The output from control 65 to shift register 66 will be a series of clock pulses at the rate of one per scan for any scan on which there is an area signal on conductor 44 for the respective gating channel. This will load shift register 66 according to the length of a particle (measured in scans).

The other output from control 65 to AND gate 62 will inhibit AND gate 62 whenever a particle is present. Thus there is no output from AND gate 62 until the scan no longer traverses a particle in that channel. When the first scan occurs which is clear of or no longer traverses a particle in that particular gating channel there will be an enabling signal from control 65 to AND gate 62. If the arithmetic unit 61 also provides an enabling signal indicating the particle is to be deflected, then AND gate 62 will pass the decision control signal from gate 63 to shift register 67 which causes the transfer of stored information from register 66 to 67.

The signal from timer 55 now controls the advance of information from shift register 67 via conductor 68 to OR gates 70 and 71 which operate air valve controls 74 and 75 respectively through appropriate delay means to cause a deflecting blast of air in the respective blast channels.

The reset circuitry has not been indicated for simplicity of drawing and description. It is believed those familiar with the art will realize such circuitry is required and is well known. For example, once the transfer of information from register 66 takes place, the arithmetic unit 61 and register 66 are reset.

It is thought that the operation of the tracking system will be clear, however, a brief description will be given of some examples of typical particles as they move through the sorting zone.

Figure 5:
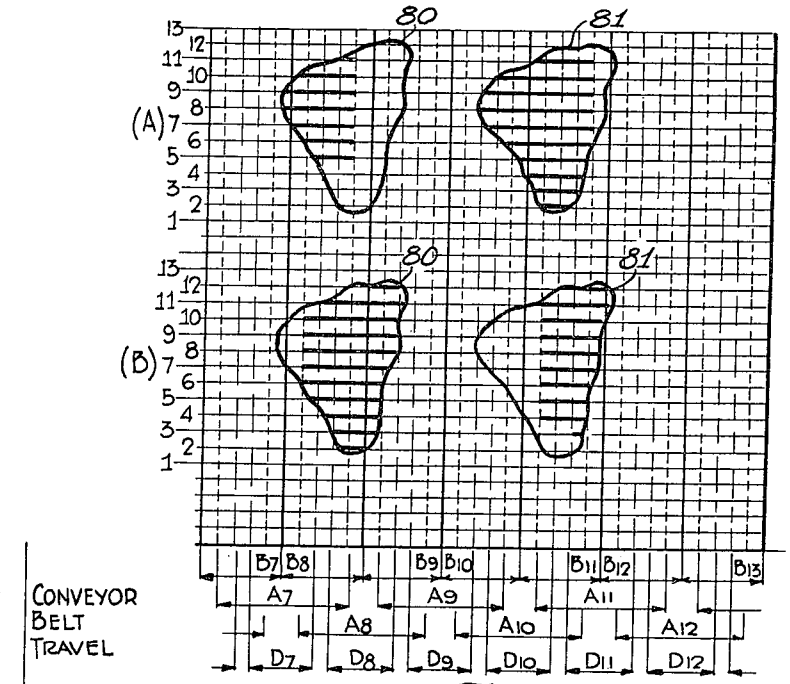

Referring now to FIG. 5, two pieces of material such as pieces or particles of rock are shown as 80 and 81 in an upper part (A) and a lower part (B) of the drawing. The two parts of the drawing are used to show how the overlapping channels handle these particular particles.

The particles 80 and 81 are shown to be of similar size and shape but their lateral position with reference to blast channel boundaries is different.

Referring first to FIG. 5(A), the particle 80 has a portion lying in analysing channel A7 and will be analysed by that channel as follows. The scans indicated at 2, 3 and 4 will traverse this particle 80 but no data will be provided for analysis because nothing appears in gating channel D7. On scan 5 a portion does appear in gating channel D7 and data will be provided for analysis in channel A7 as is indicated by the heavy line portion of scan 5. Similarly scans 6 – 11 will provide data for analysis. Thus, a decision will be made by channel A7 circuitry to accept or reject on the basis of the data in scans 5 – 11. If the particle is to be deflected (as described in connection with the embodiment of FIG. 2(A)) the deflection devices for blast channels B7 and B8 will be actuated.

The particle 80 will also be analysed by analysing channel A8 which overlaps and this is shown in (B) of FIG. 5. The data from scans 2 – 12, as indicated by the heavy lines, will be analysed. It will be seen that the analysing channel A8 will provide for analysis of the data on substantially the entire particle and will thus give an accurate analysis.

Referring still to FIG. 5, the particle 81 occupies a different lateral position, and as shown in (A) the analysing channel A10 will analyse data from scans 2 – 12. It is this channel A10 that will analyse substantially the entire particle and provide the more accurate decision. If the particle is to be deflected the deflection devices of blast channels B10 and B11 will be actuated. However, as indicated in FIG. 5(B), particle 81 is also analysed by analysing channel A11. Scan 2 does not provide data for analysis because nothing appears on that scan in gating channel D11. On scan 3 a portion of particle 81 is scanned in gating channel D11 as indicated by the heavy line. This will initiate the analysis, and data from scans 4 – 12 will be analysed by analysing channel A11. The data analysed by analysing channel A11 is indicated by heavy lines. It will be seen that only a portion of the particle is analysed by this channel.

From the preceding description with reference to FIG. 5 it will be seen that a particle will be analysed by more than one overlapping channel in most instances if the design is appropriate, but that one of the channels will analyze all or a substantial portion of the particle to provide efficient sorting.

Figure 6:
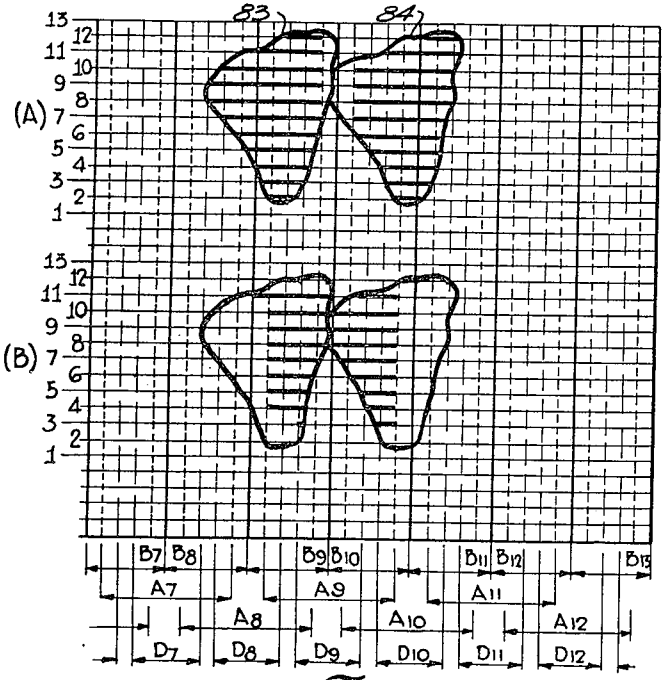

The situation is not as straightforward when two particles are touching, but nevertheless the accuracy achieved by the present system is quite good. FIG. 6 in (A) shows two touching particles 83 and 84 as they would be analysed by analysing channels A8 and A10, and in (B) shows the same two particles as they would be analysed by analysing channel A9. The heavy lines indicate the scans which provide data for analysis as before. In FIG. 6(A) it will be seen that analysing channel A8 analyses data from a very large portion of particle 83 and analysing channel A10 analyses data from a very large portion of particle 84. Thus substantially all of each particle is subjected to an analysis by separate channels and it is to be expected the sorting will be accurate. If particle 83 is to be deflected, the deflection devices for blast channels B8 and B9 will be actuated. If particle 84 is to be deflected, the deflection devices for blast channels B10 and B11 will be actuated. Thus, either particle can be accepted or rejected without interference resulting from the other analysing channel.

However, analysing channel A9 will also analyse data on the composite (particle 83 and 84) particle as indicated by the heavy lines in (B) of FIG. 6. It will be seen that channel A9 views approximately 50% of the surface of each particle. If both particles are to be accepted, or if both are to be rejected, then the decision by channel A9 should be in agreement with the results from channels A8 and A10 and therefore the decision of channel A9 is not of any significance. Accurate sorting will result in this situation. In the event that one particle should be accepted and the other should be rejected, in fact they may be ore and waste in varying degrees, then the channel A9 decision cannot be predicted. The circuitry (in this instance as described in connection with FIG. 2(A)) is arranged so that either channel A8 or A9 can cause a deflection in blast channel B9 and similarly channel A9 or A10 can cause a deflection in channel B10. If channel A9 does not cause a deflection with regard to blast channels B9 and B10, the outcome reverts to dependence upon the decisions from channels A8 and A10. The accuracy is not affected. But if channel A9 does decide to cause a deflecting blast for its composite particle, both particles 83 and 84 will probably be deflected and in this situation sorting errors could result. Thus, it will be seen that when two touching particles are considered, and where one is ore and one is waste, and when the overlapping analysing channel that is considering a relatively large portion of each particle decides to deflect the particles, there could be sorting errors result. The degree of the error will depend on the position of the particles, their composition and their size as well as other factors.

It is believed the description thus far sets forth the operation of the tracking system and the apparatus quite clearly. It will be apparent that alternative circuitry could be provided to carry out the operation of the embodiment specifically shown. This preceding description has related generally to the overlapping channels extending longitudinally (i.e. in the direction in which particles move through the sorting zone). In addition, an arrangement of overlapping channels extending transversely, may be used if desired to improve the definition with regard to the direction of flow. An arrangement for doing this will be described with reference to FIG. 7.

Figure 3:
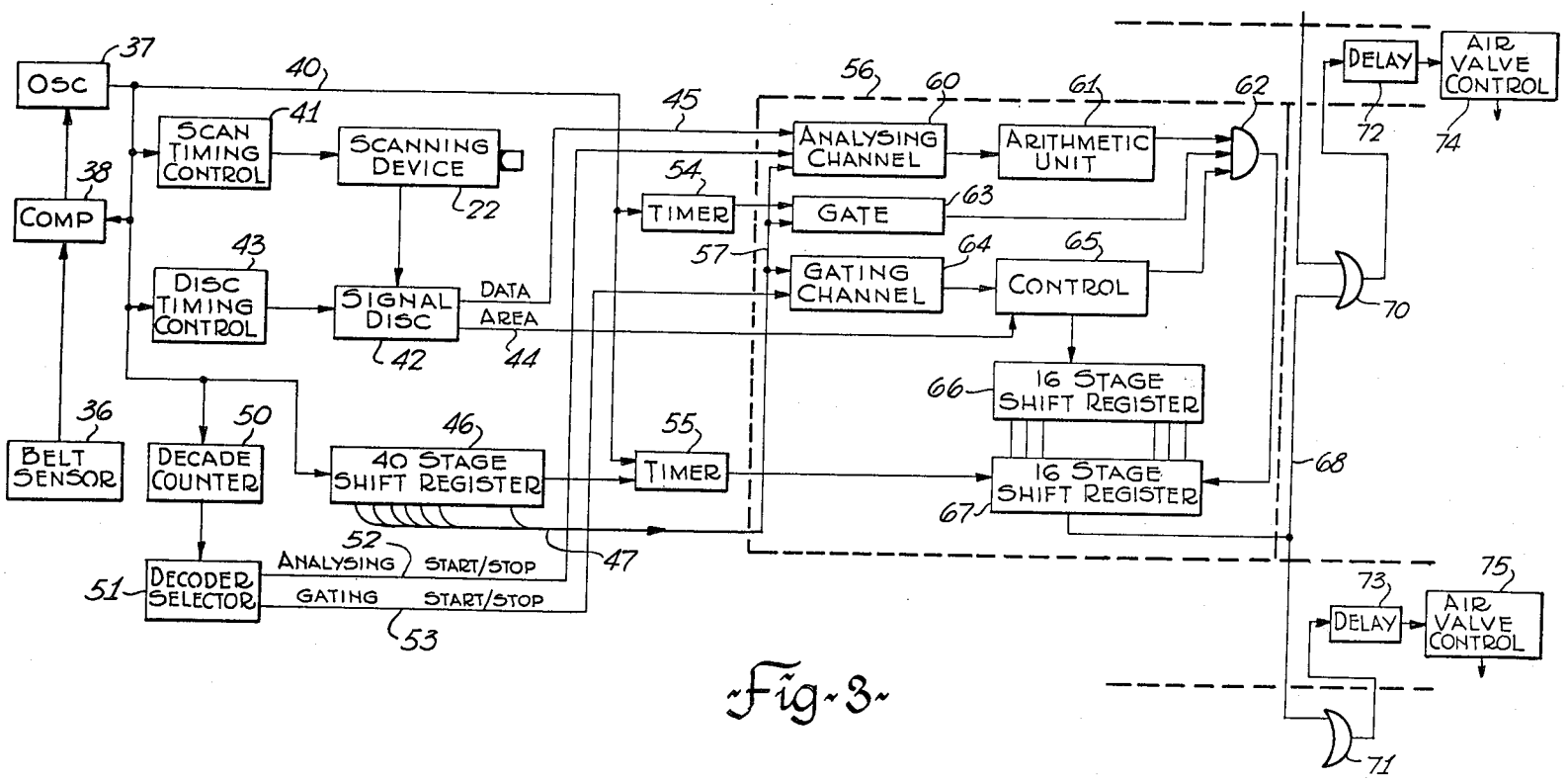
FIG. 3 is a schematic block diagram showing an embodiment of the invention.
Figure 4:
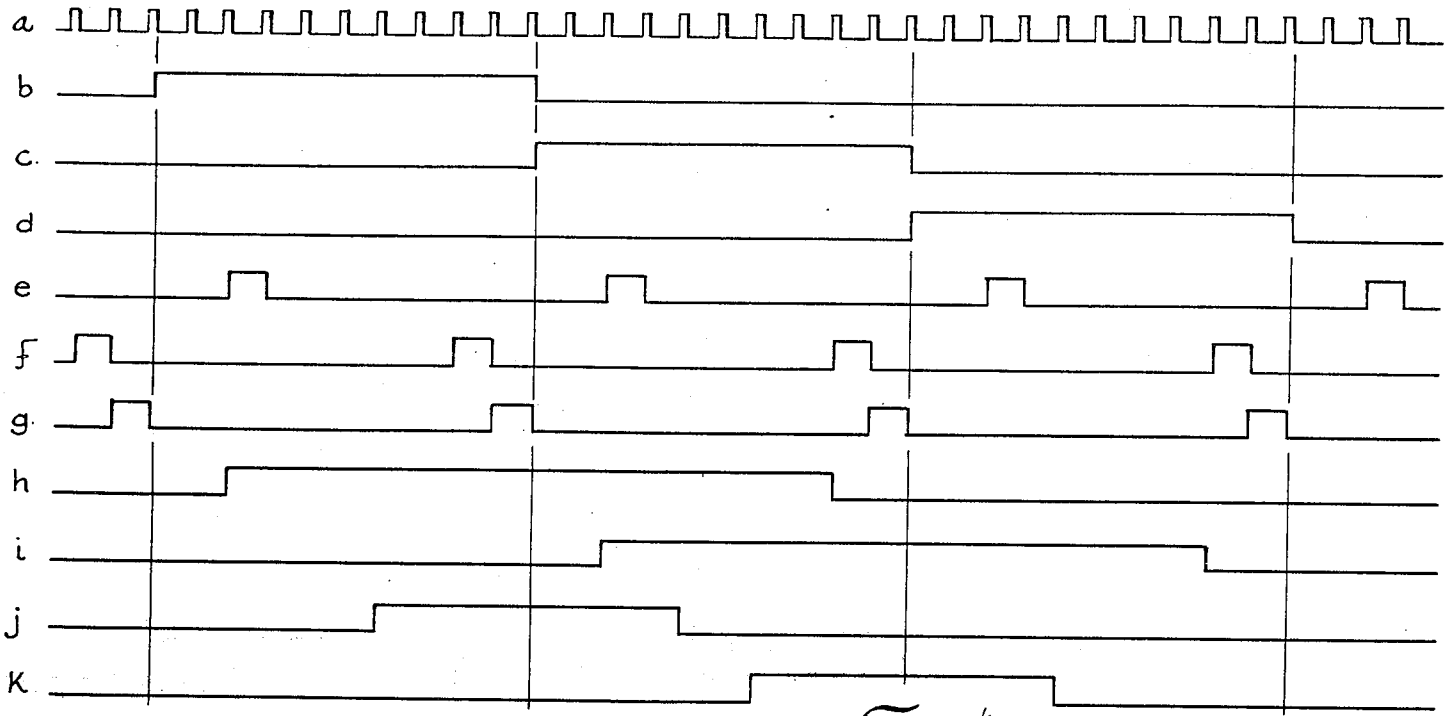
FIG. 4 is a waveform diagram useful in describing the diagram of FIG. 3.

The circuitry of FIG. 7 is substantially the same as that of FIG. 3, but there is provided an additional set of analysing modules to provide overlapping channels lying parallel to the direction of the scan. Each one of the previously described modules (e.g. shown by 56 in FIG. 3) is now replaced by a pair of modules. In addition there is a scan counter 85 which receives one pulse per scan from shift register 46, and a decoder 86. The decoder produces overlapping pulse trains as indicated in FIG. 8 which may comprise a high for the duration of one scan and a low for say 7 scans. The pulse trains are applied to OR gates 90 and 91. The outputs of control 65 are also applied to the respective OR gate in the respective module. This has the effect of overriding the output of the controls 65 causing the circuits to give decisions and to reset on the selected scan whether or not the end of a particle has been reached. The decision circuitry operates as before under control of circuit 65 for the interval of seven scans. The additional shift registers 92 and 93 function as registers 66 and 67 in the other module. Register 93 is connected into OR gates 70 and 71 as shown.

It is believed the operation of FIG. 7 is now clear. An improved accuracy in the Y direction is achieved at the cost of another set of modules. The circuitry calls for decisions at a predetermined number of scans as well as when the end of a piece of material leaves the scanning zone.

The embodiments of the invention in which an exclusive property or privilege is claimed are defined as follows:

1. A tracking system for a sorting apparatus for sorting pieces of material moving through a sorting zone in a wide path random stream, comprising scanning means to make repeated scans across the sorting zone to detect light reflected from discrete areas of each piece of material as the scan traverses the piece of material and to provide a scan signal representative of the reflected light, a plurality of deflection devices downstream of said scanning means extending across said sorting zone, each device having a first condition which permits pieces of material passing it to follow a predetermined undeflected path and a second condition in which passing pieces of material are deflected from said predetermined path, electronic means generating timing signals, first timing control means receiving said timing signals to provide scan control signals to control the rate at which the scan traverse the sorting zone, second timing control means receiving said timing signals to provide a plurality of outputs defining a plurality of overlapping analysing channels each extending parallel to the direction of movement of the pieces of material through the sorting zone, circuit means for each analysing channel each receiving said scan signal and a respective timing signal for accumulating information from said scan signal relating to pieces of material in the respective analysing channel and providing a decision signal based on the accumulated information from a piece of material, and control means for each analysing channel responsive to said decision signal to actuate a number of deflection devices extending at least the width of the analysing channel.

2. A tracking system according to claim 1 in which said timing signals defining a plurality of analysing channels are arranged to define at least two sets of analysing channels, each set positionally displaced from each other set to effect a predetermined overlapping arrangement.

3. A tracking system according to claim 1 in which the deflection devices are air blast nozzles for directing a deflecting blast of air towards passing pieces of material.

4. A tracking system according to claim 1 and including further electronic means generating additional timing signals related to a predetermined number of scans and representing a plurality of overlapping analysing channels each extending transversely across the sorting zone in a direction substantially at right angles to the direction of movement of pieces of material through said sorting zone, said additional timing signals being applied to said circuit means for initiating the provision of said decision signal at intervals defined by said predetermined number of scans.

5. A tracking system for a sorting apparatus for sorting pieces of material moving through a sorting zone in a wide path random stream, comprising scanning means to make repeated scans across the sorting zone to detect light reflected from discrete areas of each piece of material as the scan traverses the pieces of material and to provide a scan signal representative of the reflected light, a plurality of deflection devices downstream of said scanning means extending across said sorting zone, each device having a first condition which permits pieces of material passing it to follow a predetermined undeflected path and a second condition in which passing pieces of material are deflected from said predetermined path, electronic means generating timing signals, first timing control means receiving said timing signals to provide scan control signals to control the rate at which the scan traverses the sorting zone, second timing control means receiving said timing signals to provide a plurality of outputs defining (a) a series of overlapping analysing channels each extending parallel to the direction of movement of the pieces of material through the sorting zone, said series comprising a first set of analysing channels disposed across said wide path random stream and having a predetermined space between adjacent analysing channels, and at least a second set of analysing channels each extending across a respective one of the predetermined spaces between adjacent channels of said first set and each overlapping portions of channels in said first set adjacent the predetermined space therebetween, and (b) a gating channel for each analysing channel, each gating channel being centered with respect to a respective analysing channel and having a width less than that of the analysing channel, a first circuit means for each gating channel, each receiving said scan signal and a respective gating signal and providing an enabling signal when a piece of material is detected in the respective gating channel, a second circuit means for each analysing channel, each receiving an enabling signal from a respective first circuit means, said scan signal, and a respective analysing channel timing signal, and when enabled accumulating information relating to pieces of material in the respective analysing channel and providing a decision signal based on the accumulated information, and control means for each analysing channel responsive to said decision signal from a respective second circuit means to actuate from said first condition to said second condition a number of deflection devices extending at least the width of the analysing channel.

6. A tracking system according to claim 5 and including further electronic means generating timing signals representing (c) a pair of overlapping analysing channels extending transversely across the sorting zone and across the direction of movement of said pieces of material, said overlapping analysing channels being defined by a predetermined number of scans, and means responsive to said signals representing the transverse pair of overlapping analysing channels for initiating the provision of said decision signal when a piece of material is being scanned at intervals corresponding to said channels being defined by said predetermined number of scans.

7. A tracking system according to claim 5 in which said analysing channels are all of the same width.

8. A tracking system according to claim 7 in which the overlapping analysing channels consist of a first, second and third set of analysing channels, each channel in said second set overlapping one channel in a pair of adjacent channels in said first set by an amount no greater than two thirds of the width of said one channel and the other channel in said pair of adjacent channels by an amount no greater than one third of the width of said other channel, each channel in said third set overlapping one channel in a pair of adjacent channels in said first set by an amount no greater than one third the width of said one channel and the other channel in said pair of adjacent channels by an amount no greater than two thirds the width of said other channel.

9. A tracking system according to claim 8 in which the width of a deflection device is slightly greater than one third the width of an analysing channel.

10. A tracking system according to claim 8, in which said deflection devices are in abutting side by side relationship across said sorting zone, and in which the number of deflection devices for actuation by each control means is three.

11. A tracking system according to claim 8 in which the width of a deflection device is slightly greater than the width of an analysing channel and in which the deflection means comprises a first row of deflection devices in abutting side by side relationship across the sorting zone, a second row of deflection devices in abutting side by side relationship, each overlapping adjacent devices in said first row by substantially two thirds and one third respectively of the width of a deflection device, and a third row of deflection devices in abutting side by side relationship, each overlapping adjacent devices in said first row by substantially one third and two thirds respectively of the width of a deflection device.

12. A tracking system according to claim 11 in which the number of deflection devices for actuation by each control means is one.

13. A tracking system according to claim 7 in which the overlapping analysing channels consist of a first set and a second set with each channel in the second set being centered with respect to a respective predetermined space between adjacent channels in said first set.

14. A tracking system according to claim 13 in which each channel in said second set of analysing channels overlaps portions of channels in said first set adjacent a respective predetermined space by an amount of less than half the width of a channel for each overlap.

15. A tracking system according to claim 14 in which the width of a deflection device is greater than one half the width of an analysing channel and less than the width of an analysing channel.

16. A tracking system according to claim 15 in which the deflection devices are in abutting side by side relationship across said sorting zone.

17. A tracking system according to claim 15 in which the number of deflection devices for actuation by each control means is two.

18. A tracking system according to claim 14 in which the width of a deflection device is slightly greater than the width of an analysing channel, and in which a first row of deflection devices is arranged in abutting side by side relationship across said sorting zone and a second row of deflection devices is arranged longitudinally adjacent to said first row and each overlapping adjacent deflection devices in said first row.

19. A tracking system according to claim 18 in which the number of deflection devices for actuation by each control means is one.

* * * * *